US012642351B2

(12) United States Patent
Wu et al.

(10) Patent No.: US 12,642,351 B2
(45) Date of Patent: Jun. 2, 2026

(54) DETACHABLE SHELF CONNECTION STRUCTURE AND SHELF

(71) Applicant: DEKANGXING HOUSEWARE PRODUCT CO. ,LTD, Huizhou (CN)

(72) Inventors: Xiaoming Wu, Huizhou (CN); Juncai Zhang, Huizhou (CN); Liling Wu, Huizhou (CN); Jun Zhou, Huizhou (CN); Shoucai Zhang, Huizhou (CN)

(73) Assignee: DEKANGXING HOUSEWARE PRODUCT CO., LTD, Huizhou (CN)

( * ) Notice: Subject to any disclaimer, the term of this patent is extended or adjusted under 35 U.S.C. 154(b) by 0 days.

(21) Appl. No.: 19/007,677

(22) Filed: Jan. 2, 2025

(65) Prior Publication Data

US 2026/0144366 A1 May 28, 2026

(30) Foreign Application Priority Data

Nov. 25, 2024 (CN) ..... 202422882606.4

(51) Int. Cl.
*A47B 57/26* (2006.01)
*A47B 57/54* (2006.01)

(52) U.S. Cl.
CPC ..... *A47B 57/545* (2013.01); *A47B 57/26* (2013.01); *A47B 57/265* (2013.01)

(58) Field of Classification Search
CPC ..... A47B 57/545; A47B 57/265; A47B 57/26
USPC ..... 211/187
See application file for complete search history.

(56) References Cited

U.S. PATENT DOCUMENTS

| | | | | |
|---|---|---|---|---|
| 4,595,107 | A * | 6/1986 | Welsch | A47B 57/265 D34/21 |
| 5,779,070 | A * | 7/1998 | Dickinson | A47B 57/265 211/187 |
| 7,543,540 | B2 * | 6/2009 | Tatematsu | F16B 12/46 108/192 |
| 11,627,802 | B1 * | 4/2023 | Liu | A47B 57/40 211/187 |
| 2002/0046982 | A1 * | 4/2002 | Guizzardi | A47B 57/545 211/187 |
| 2005/0199160 | A1 * | 9/2005 | Ching-Po | A47B 57/265 108/107 |
| 2019/0098995 | A1 * | 4/2019 | Brown | A47B 57/545 |

FOREIGN PATENT DOCUMENTS

| | | |
|---|---|---|
| CN | 202556392 | 11/2012 |

* cited by examiner

*Primary Examiner* — Stanton L Krycinski
(74) *Attorney, Agent, or Firm* — Birchwood IP

(57) ABSTRACT

The present invention discloses a detachable shelf connection structure and a shelf. The detachable shelf connection structure includes a first tube, a second tube, a clamping assembly, and a sleeve. The first tube includes a sleeve tube and a connecting tube, and the sleeve tube is connected to one end of the connecting tube; a wall of the sleeve tube or the second tube is provided with at least one clamping hole; the sleeve tube is inserted into one end of the second tube, and when the sleeve tube is connected to the second tube, the clamping hole in the sleeve tube is corresponding to the clamping hole in the second tube; and the clamping assembly clamps the clamping hole in the sleeve tube and the clamping hole in the second tube. The sleeve is disposed outside the clamping assembly and is clamped with the clamping assembly.

9 Claims, 5 Drawing Sheets

DETACHABLE SHELF CONNECTION STRUCTURE AND SHELF

CROSS-REFERENCE TO RELATED APPLICATIONS

This application claims priority to Chinese Patent Application No. 202422882606.4, filed on Nov. 25, 2024, which is hereby incorporated by reference in its entirety.

TECHNICAL FIELD

The present invention relates to the technical field of shelves, and in particular to a detachable shelf connection structure and a shelf.

BACKGROUND

A shelf is an indispensable item in household essentials. Shelves come in a wide variety of types, and regardless of shapes, most existing shelves mainly include vertical supports and horizontal shelves placed on these supports. The common vertical supports and shelves are generally fastened, non-foldable, and non-detachable, which are space-consuming and highly inconvenient for storage, transportation, and packaging.

Therefore, many detachable and foldable shelves for storing items have been developed. For example, the Chinese disclosure patent CN202556392U discloses a detachable shelf, which includes a base, with wheels installed at the bottom of the base. Support rods are disposed at corners of the base, and frames are distributed vertically above the support rods. Upper corners of the frame are provided with connecting rods, and grooves are provided at the bottom corresponding to the connecting rods. The detachable shelf has the beneficial effects of a simple structure and ease of disassembly, but a secure connection between an upper frame and a lower frame cannot be implemented in a connection method for the shelf.

SUMMARY

To overcome shortcomings in the prior art, a detachable shelf connection structure and a shelf are provided.

To achieve the above objective, the present invention provides a detachable shelf connection structure, including a first tube, a second tube, a clamping assembly, and a sleeve, and the first tube includes a sleeve tube and a connecting tube, and the sleeve tube is connected to one end of the connecting tube; either a wall of the sleeve tube or a wall of the second tube is provided with at least one clamping hole; the sleeve tube is inserted into one end of the second tube, and when the sleeve tube is connected to the second tube, the clamping hole in the sleeve tube is corresponding to the clamping hole in the second tube respectively; the clamping assembly clamps the clamping hole in the sleeve tube and the clamping hole in the second tube; and the sleeve is sleeved outside the clamping assembly, and the sleeve and the clamping assembly are clamped to each other.

According to an implementation of the present invention, the clamping assembly includes a first clamping component and a second clamping component, the first clamping component includes a first enclosure wall and a first clamping part, and the first clamping part is disposed on an inner side of the first enclosure wall; the second clamping component includes a second enclosure wall and a second clamping part, and the second clamping part is disposed on an inner side of the second enclosure wall; and the first enclosure wall and the second enclosure wall are snap fitted, and the first clamping part and the second clamping part successively penetrate the clamping hole in the second tube and the clamping hole in the sleeve tube.

According to an implementation of the present invention, the outer diameter of the sleeve tube is less than or equal to the inner diameter of the second tube.

According to an implementation of the present invention, the outer diameter of the connecting tube is equal to the inner diameter of the second tube.

According to an implementation of the present invention, the inner diameter of the clamping assembly is equal to the inner diameter of the second tube or the connecting tube.

According to an implementation of the present invention, the clamping assembly has a first end and a second end, and the outer diameter of the clamping assembly gradually increases along a direction from the first end to the second end; the sleeve has a third end and a fourth end, and the inner diameter of the sleeve gradually increases along a direction from the third end to the fourth end; and a minimum inner diameter of the sleeve is less than or equal to a minimum outer diameter of the clamping assembly, and a maximum inner diameter of the sleeve is less than or equal to a maximum outer diameter of the clamping assembly.

According to an implementation of the present invention, the at least one clamping hole is formed at one end of the connecting tube away from the sleeve tube.

According to an implementation of the present invention, the at least one clamping hole is formed at one end of the second tube away from the first tube.

According to an implementation of the present invention, an edge of the first enclosure wall is provided with a first snap-fit structure, an edge of the second enclosure wall is provided with a second snap-fit structure, and the first snap-fit structure and the second snap-fit structure are matched with each other.

According to another implementation of the present invention, a shelf is further provided, including the above detachable shelf connection structure.

Beneficial effects of the present invention are as follows: the sleeve tube of the first tube is inserted at one end of the second tube, so that the first tube is connected to the second tube. Clamping holes are respectively provided in a wall of the sleeve tube and a wall of the second tube, and the clamping hole provided in the sleeve tube is corresponding to the clamping hole provided in the second tube when the sleeve tube is connected to the second tube. The clamping assembly is clamped with the clamping hole in the second tube and the clamping hole in the sleeve tube, to prevent separation of the first tube and the second tube. In addition, the sleeve is sleeved outside the clamping assembly, and the sleeve and the clamping assembly are clamped to each other, so that the sleeve is relatively fastened relative to the first tube and the second tube, and support for a connection between the first tube and the second tube is increased.

BRIEF DESCRIPTION OF DRAWINGS

The accompanying drawings described herein are intended to provide a further understanding of this application, and constitute a part of this application. Example embodiments of this application and descriptions thereof are intended to describe this application, and do not constitute limitations on this application. In the accompanying drawings.

REFERENCE NUMERALS

Figure 1:
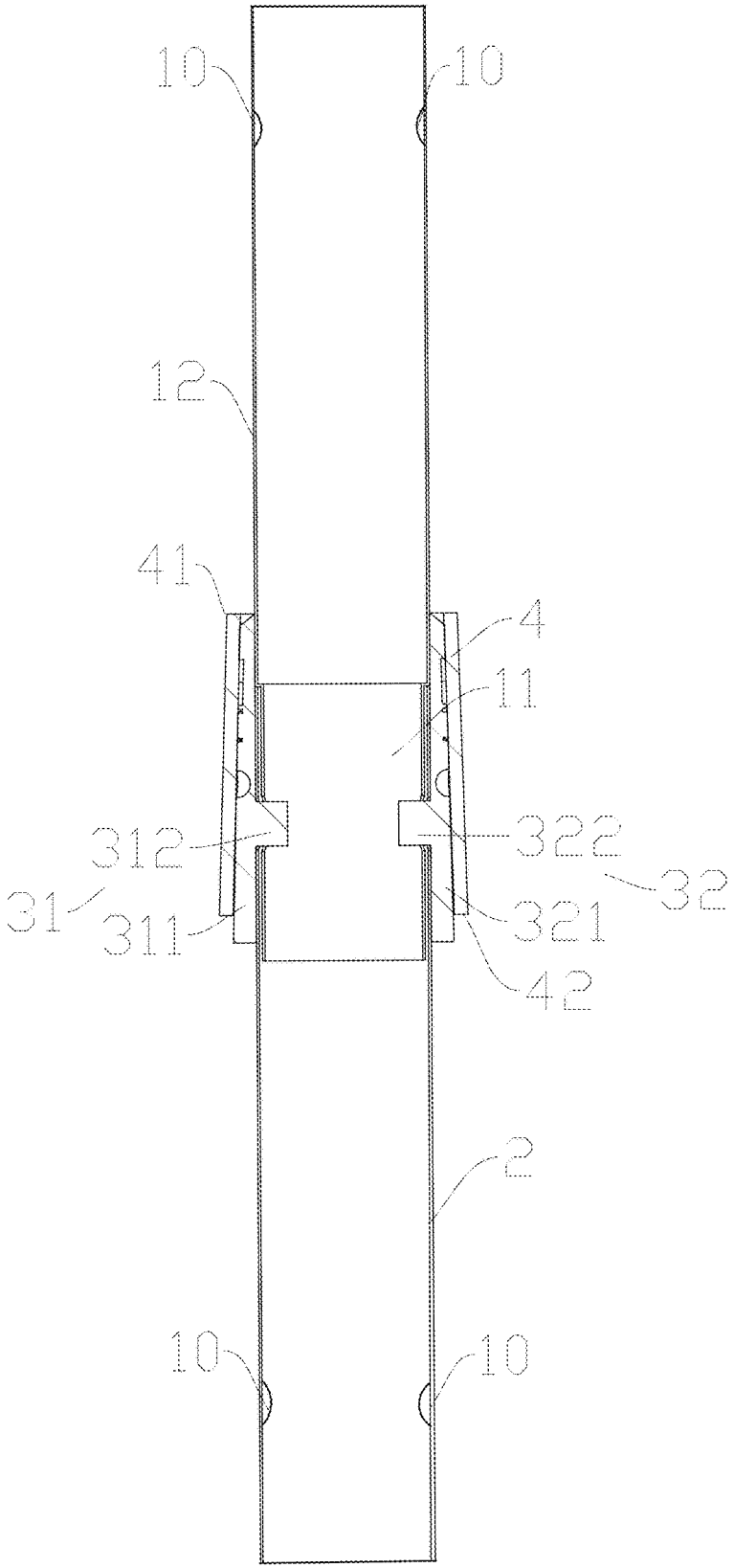
FIG. 1 is a sectional view of a detachable shelf connection structure according to a first embodiment.

1. first tube; 10. clamping hole; 11. sleeve tube; 12. connecting tube; 2. second tube; 3. clamping assembly; 30. clamping end; 31. first clamping component; 32. second clamping component; 33. first end; 34. second end; 311. first enclosure wall; 312. first clamping part; 321. second enclosure wall; 322. second clamping part; 3110. first snap-fit structure; 3210. second snap-fit structure; 4. sleeve; 41. third end; 42. fourth end; 5. frame; 6. pillar.

DESCRIPTION OF EMBODIMENTS

A plurality of implementations of the present invention are disclosed in drawings below, and for the sake of clarity, many practical details are stated in the following description. It should be understood, however, that these practical details should not be used to limit the present invention. To be specific, in some implementations of the present invention, these practical details are not necessary. In addition, for the sake of simplifying the drawings, some conventional structures and components are depicted in a simple schematic way in the drawings.

In addition, descriptions in the present invention involving "first", "second", and the like, are only for descriptive purposes and do not specifically mean an order or sequence, and are not used to limit the present invention, but are only intended to distinguish components or operations described in same technical terms, and cannot be construed as indicating or implying relative importance or implying the number of technical features indicated. Therefore, a feature defined by "first" or "second" may explicitly or implicitly include at least one such feature. In addition, the technical solutions between the various embodiments may be combined with each other, but must be implemented by those who are skilled in the art. When the combination of technical solutions contradicts each other or cannot be implemented, it shall be deemed that the combination of such technical solutions does not exist, and is not within the scope of protection claimed by the present invention.

First Embodiment

Figure 2:
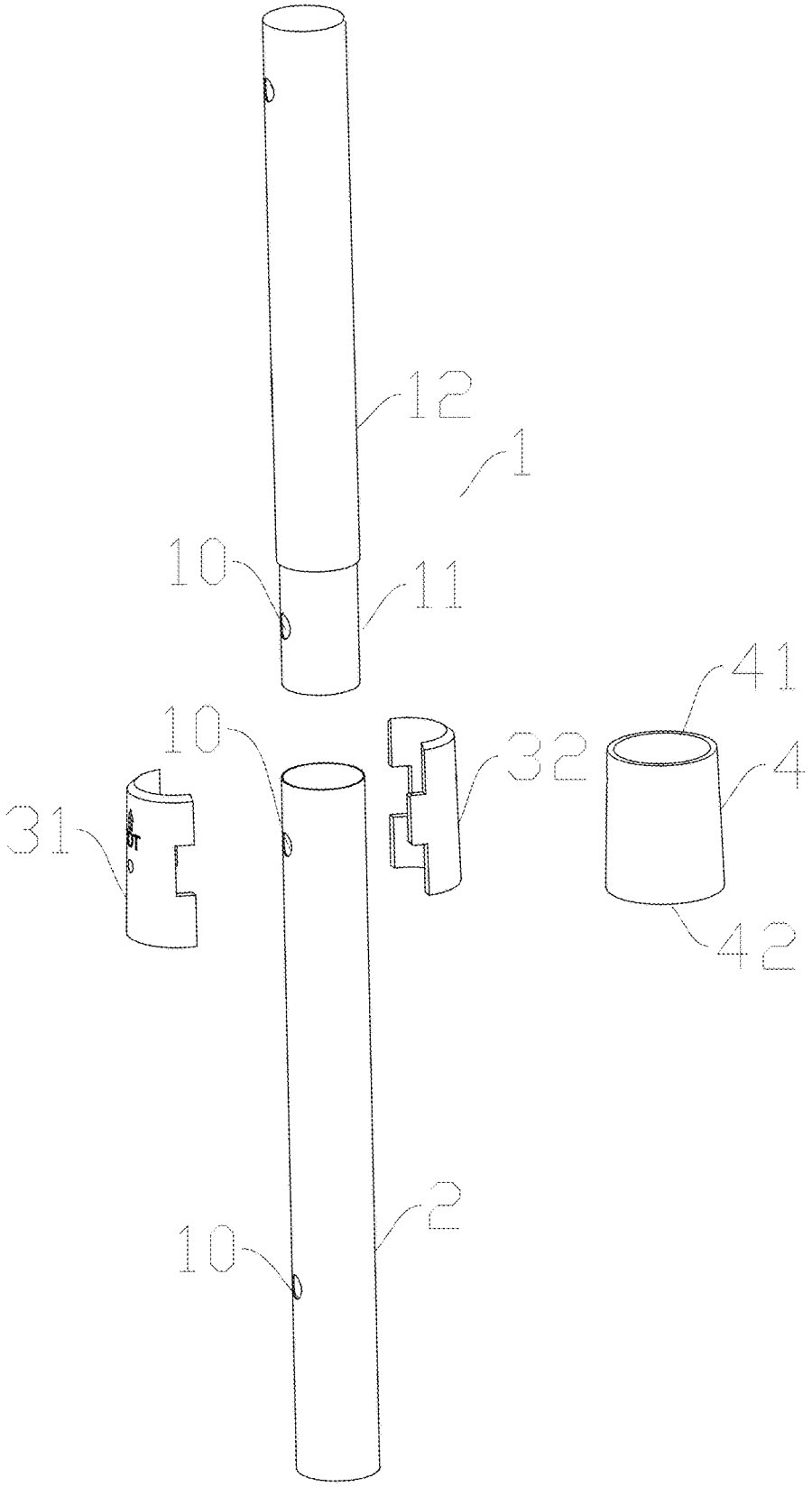
FIG. 2 is an exploded view of the detachable shelf connection structure according to the first embodiment.
Figure 3:
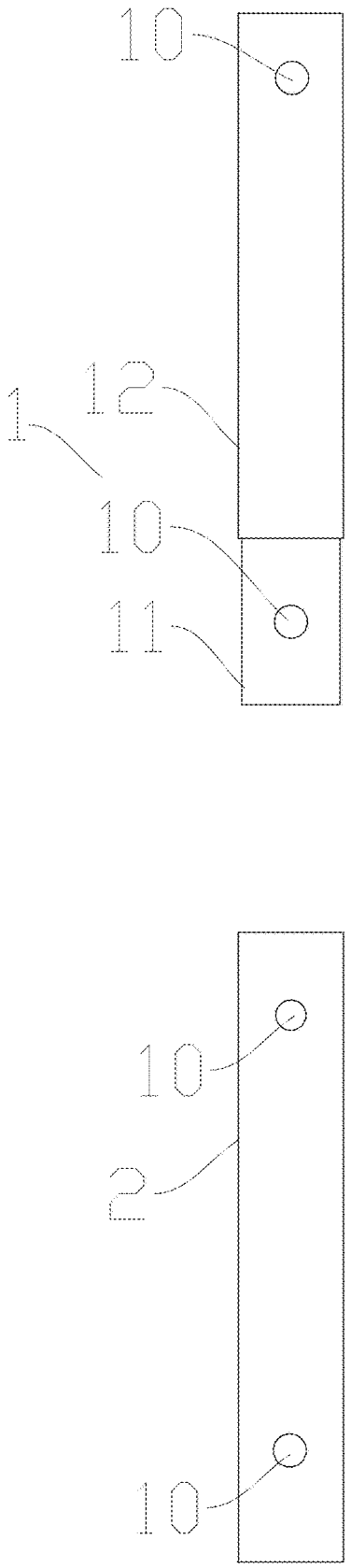
FIG. 3 is a schematic diagram of a first tube and a second tube according to the first embodiment.

Refer to FIG. 1 to FIG. 3. FIG. 1 is a sectional view of a detachable shelf connection structure, FIG. 2 is an exploded view of the detachable shelf connection structure, and FIG. 3 is a schematic diagram of a first tube and a second tube. This embodiment provides the detachable shelf connection structure, including a first tube 1, a second tube 2, a clamping assembly 3, and a sleeve 4. The first tube 1 includes a sleeve tube 11 and a connecting tube 12, and the sleeve tube 11 is connected to one end of the connecting tube 12. During connection, the sleeve tube 11 is inserted into the second tube 2, so that the first tube 1 and the second tube 2 are detachably connected. Further, either a wall of the sleeve tube 11 or a wall of the second tube 2 is provided with at least one clamping hole 10. It should be noted that there may be one or more clamping holes 10. When there are two clamping holes 10, the two clamping holes 10 can be arranged at intervals or arranged opposite to each other. When there are more than two clamping holes 10, all clamping holes 10 are arranged at intervals. In this embodiment, the wall of the sleeve tube 11 is provided with two clamping holes 10, which are arranged opposite to each other. A wall of one end of the second tube 2 is correspondingly provided with two clamping holes 10. When the sleeve tube 11 is connected to the second tube 2, one end of the second tube 2 is sleeved outside the sleeve tube 11, and the two clamping holes 10 in the second tube 2 are corresponding to the two clamping holes 10 in the sleeve tube 11. When the clamping assembly 3 is connected to the second tube 2 and the sleeve tube 11, the clamping assembly 3 penetrates the clamping holes 10 in the sleeve tube 11 and the second tube 2. With this arrangement, the connection between the sleeve tube 11 and the second tube 2 is further reinforced through the cooperation of the clamping holes 10 and the clamping assembly 3, preventing the sleeve tube 11 from falling from the second tube 2, thereby implementing a secure connection between the first tube 1 and the second tube 2. The sleeve 4 is sleeved outside the clamping assembly 3, and the sleeve 4 is clamped to the first tube 1 and the second tube 2 through the clamping assembly 3, ensuring that the sleeve 4 remains fastened relative to the first tube 1 and the second tube 2. In addition, the sleeve 4 is sleeved on an outer side of a connection between the first tube 1 and the second tube 2, to enhance the support at the connection between the first tube 1 and the second tube 2. When the first tube 1 and the second tube 2 experience shaking due to an external force, the sleeve 4 functions to reinforce the connection between the first tube 1 and the second tube 2, further enhancing connection stability between the first tube 1 and the second tube 2

When the connection structure needs to be detached, the sleeve 4 is moved in a direction away from the clamping assembly 3, causing the sleeve 4 to detach from the connection with the clamping assembly 3. Then the clamping assembly 3 is removed, so that a clamping end 30 of the clamping assembly 3 is separated from the clamping hole 10. Finally, the sleeve tube 11 of the first tube 1 is taken out from the second tube 2, so that detaching of the connection structure is completed. In this manner, detachable connection of the connection structure is implemented, so that the shelf is easily stored and transported in a practical application scenario.

Further, the outer diameter of the sleeve tube 11 is less than or equal to the inner diameter of the second tube 2, so that when the first tube 1 is connected to the second tube 2, the sleeve tube 11 can stretch into the second tube 2. In this embodiment, the outer diameter of the sleeve tube 11 is equal to the inner diameter of the second tube 2, so that an outer wall of the sleeve tube 11 is closely attached to an inner wall of the second tube 2, and the first tube 1 is firmly connected to the second tube 2.

Further, the outer diameter of the connecting tube 12 is equal to the outer diameter of the second tube 2. When the first tube 1 is connected to the second tube 2, the sleeve tube 11 of the first tube 1 extends into the second tube 2, and the connecting tube 12 is connected to an end of the tube 2. Because the outer diameter of the connecting tube 12 and the outer diameter of the second tube 2 are equal, when the first tube 1 is connected to the second tube 2, a surface of a joint between the first tube and the second tube is flat, to facilitate connection among the clamping assembly 3, the first tube 1, and the second tube 2.

Figure 4:
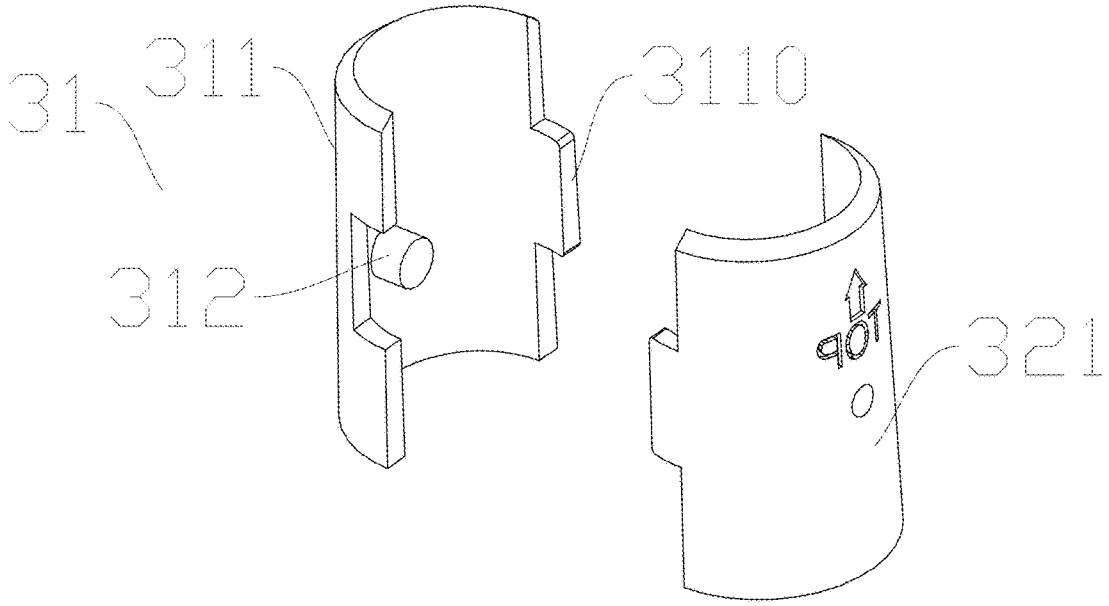
FIG. 4 is an exploded view of a clamping assembly according to the first embodiment.
Figure 5:
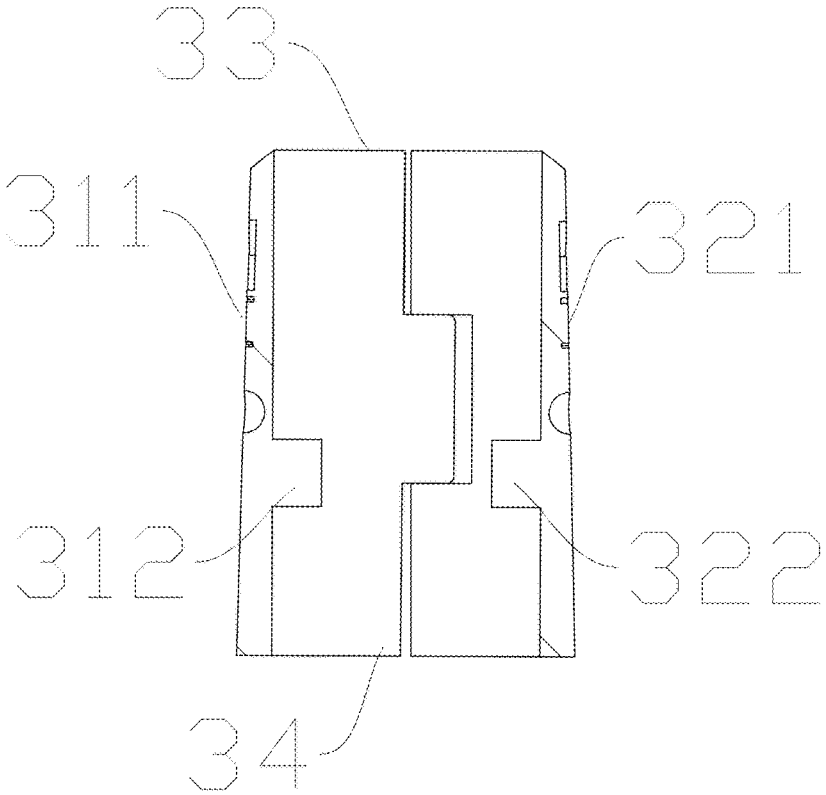
FIG. 5 is a sectional view of the clamping assembly according to the first embodiment.

Refer to FIG. 4 and FIG. 5. FIG. 4 is an exploded view of the clamping assembly, and FIG. 5 is a sectional view of the clamping assembly. The clamping assembly 3 includes a first clamping part 31 and a second clamping component 32. The first clamping component 31 includes a first enclosure wall 311 and a first clamping part 312, and the first clamping part 312 is disposed on an inner side of the first enclosure wall 311. The second clamping component 32 includes a second enclosure wall 321 and a second clamping part 322, and the second clamping part 322 is disposed on an inner side of the second enclosure wall 321. During use, the first enclosure wall 311 and the second enclosure wall 321 are snap fitted, and the first clamping part 312 and the second clamping part 322 successively penetrate the clamping hole 10 in the second tube 2 and the clamping hole in the sleeve tube 11.

In this embodiment, a wall of the sleeve tube 11 and a wall of the second tube 2 are both provided with two clamping holes 10, two clamping holes 10 in the wall of the sleeve tube 11 are arranged opposite to each other, and clamping holes 10 in the wall of the second tube 2 are arranged opposite to each other. When the first tube 1 is connected to the second tube 2, the clamping holes 10 in the sleeve tube 11 are corresponding to the clamping holes 10 in the second tube 2 respectively. In an actual use scenario, the first clamping part 312 of the first clamping component 31 extends into a clamping hole 10 on one side of the second tube 2 and a clamping hole 10 on one side of the sleeve tube 11 in turn, and an inner side of the first enclosure wall 311 abuts against an outer wall of the second tube 2. Then, the second clamping part 322 of the second clamping component 32 extends into a clamping hole 10 on the other side of the second tube 2 and a clamping hole 10 on the other side of the sleeve tube 11, to strengthen a secure connection between the second tube 2 and the sleeve tube 11. In addition, the first enclosure wall 311 and the second enclosure wall 321 are snap fitted and enclose a junction between the first tube 1 and the second tube 2, to provide support for the connection between the first tube 1 and the second tube 2.

Further, an edge of the first enclosure wall 311 is provided with a first snap-fit structure 3110, an edge of the second enclosure wall 321 is provided with a second snap-fit structure 3210, and the first snap-fit structure 3110 and the second snap-fit structure 3210 are matched with each other. When the first clamping component 31 is connected to the second clamping component 32, the first snap-fit structure 3110 and the second snap-fit structure 3210 are embedded into each other, so that the first clamping component 31 is precisely connected to the second clamping component 32.

Further, the inner diameter of the clamping assembly 3 is equal to the outer diameter of the second tube 2. When the clamping assembly 3 is connected to the first tube 1 and the second tube 2, the inner wall of the clamping assembly 3 is closely attached to the connecting tube 12 of the first tube 1 and an outer wall of the second tube 2, to prevent the clamping assembly 3 from falling off.

In addition, the clamping assembly 3 has a first end 33 and a second end 34, and the outer diameter of the clamping assembly 3 gradually increases along a direction from the first end 33 to the second end 34. The sleeve 4 has a third end 41 and a fourth end 42, and the inner diameter of the sleeve 4 gradually increases along a direction from the third end 41 to the fourth end 42. A minimum inner diameter of the sleeve 4 is less than or equal to a minimum outer diameter of the clamping assembly 3, and a maximum inner diameter of the sleeve 4 is less than or equal to a maximum outer diameter of the clamping assembly 3. In this embodiment, the minimum inner diameter of the sleeve 4 is less than the minimum outer diameter of the clamping assembly 3, and the maximum inner diameter of the sleeve 4 is less than the maximum outer diameter of the clamping assembly 3. When the sleeve 4 is connected to the clamping assembly 3, the fourth end 42 of the sleeve 4 is sleeved outside the clamping assembly 3 along a direction from the first end 33 to the second end 34 of the clamping assembly 3, the first end 3 of the clamping assembly 33 is clamped on an inner wall of the sleeve 4, an outer wall of the clamping assembly 3 is attached to the inner wall of the sleeve 4, so that a frictional force is generated between the sleeve 4 and the clamping assembly 3, and the sleeve 4 is closely connected to the clamping assembly 3. When an external force is applied to the sleeve 4, an interaction force is generated between the sleeve 4 and the clamping assembly 3. As the force applied to the sleeve 4 is greater, the connection between the sleeve 4 and the clamping assembly 3 is tighter. In this way, a stress degree of the shelf connection structure is increased, and a load strength of the shelf is improved effectively in an actual application scenario.

In an embodiment, at least one clamping hole 10 is formed at one end of the connecting tube 12 away from the sleeve tube 11. In this embodiment, two clamping holes 10 are formed at the end of the connecting tube 12 away from the sleeve tube 11, so that a quantity of clamping holes 10 in the connecting tube 12 matches a quantity of clamping holes 10 in the sleeve tube 11. Two first tubes 1 are connected to each other by inserting a sleeve tube 11 of one of the two first tubes 1 into a connecting tube 12 of the other of the two first tubes 1. The first tube 1 is formed as a standard part, so that the shelf connection structure is easily processed and produced, improving the generation efficiency and facilitating installation. In an actual application scenario, layers of the shelf can be increased by increasing a corresponding quantity of first tubes 1, clamping assemblies 3, and sleeves 4. In this manner, a user can make DIY settings on the shelve according to different needs, so that the shelf is used in various ways, and the shelve can be applied to more scenarios.

Further, at least one clamping hole 10 is formed at one end of the second tube 2 away from the first tube 1. In this example, two clamping holes 10 are formed at one end of the second tube 2 away from the first tube 1, so that a quantity of clamping holes 10 at the end of the second tube 2 away from the first tube 1 matches a quantity of clamping holes 10 at the other end of the second tube 2. A clamping hole 10 is formed at one end of the second tube 2 away from the first tube 1, so that the end of the second tube 2 away from the first tube 1 can also be connected to the clamping component 3 and the sleeve 4.

Second Embodiment

In this embodiment, a shelf is provided, including at least three groups of detachable shelf connection structures and at least one frame 5. Each detachable shelve connection structure includes a first tube 1, a second tube 2, a clamping assembly 3, and a sleeve 4. A connection manner for the first tube 1, the second tube 2, the clamping assembly 3, and the sleeve 4 is the same as a connection manner in the first embodiment, which is not described herein. This embodiment is different from the first embodiment in that at least three sleeves 4 are also connected to the shelf 5, and each shelf 5 is clamped on three clamping assemblies 3 through three sleeves 4, so that the shelf 5 remains fastened relative to three groups of first tubes 1 and second tubes 2 that are connected.

Figure 6:
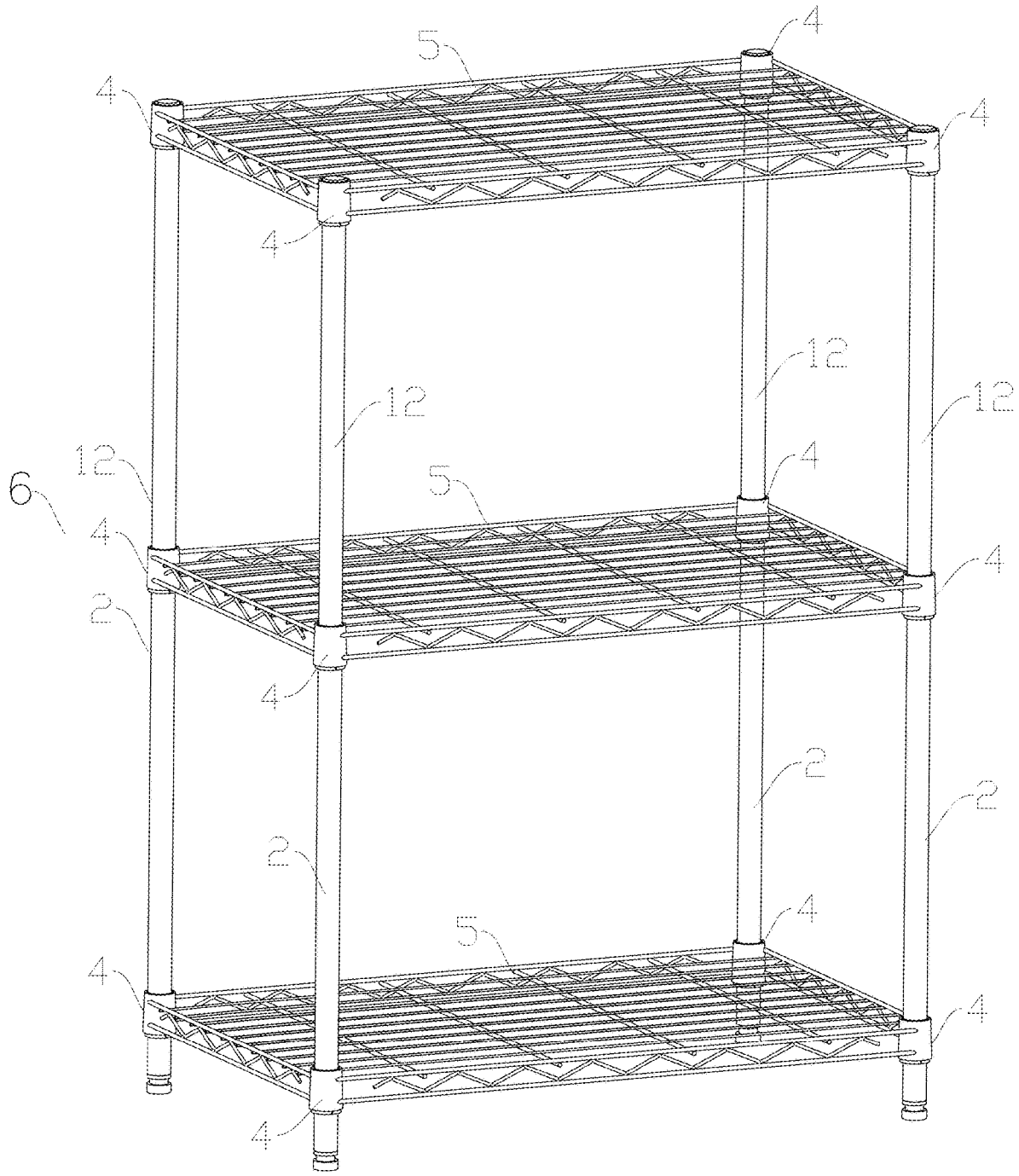
FIG. 6 is a schematic diagram of the shelf according to a second embodiment.

Refer to FIG. 6. FIG. 6 is a schematic diagram of the shelf in this embodiment. In this embodiment, four groups of shelf connection structures are used as an example. The four groups of shelf connection structures are respectively disposed at four corners of frames 5, and sleeves 4 of each group of frame connection structure are connected to the four corners of the frames 5. Each sleeve 4 is clamped with a clamping assembly 3 connected to a first tube 1 and a second tube 2, so that the frames 5 are connected to the four groups of shelf connection structures.

Further, to increase a quantity of layers of the shelf, the shelf in this embodiment further includes eight clamping assemblies 3, eight sleeves 4, and two frames 5 in addition to the four groups of shelf connection structures. One end that is of a connecting tube 12 of a first tube 1 of each group of shelf connection structure and that is away from a sleeve tube 11 is connected to one clamping assembly 3, and one end of the second tube 2 away from the first tube 1 is also connected to one clamping assembly 3. Four corners of each frame 5 are respectively connected to sleeves 4, the sleeve 4 is configured to connect the frame 5 to the clamping assembly 3 on a pillar 6, and the frame 5 is firmly connected to the pillar 6 through clamping between the sleeve 4 and the clamping assembly 3.

During connection, each frame 5 is respectively sleeved outside four groups of clamping assemblies 3 of the same height on the pillar 6 through four sleeves 4, and each sleeve 4 is correspondingly clamped with one clamping assembly 3, to implement a secure connection between the frame 5 and the pillar 6. When an object is placed in the frame 5, an interaction force is generated between the sleeve 4 and the clamping assembly 3, and as the weight of the object is greater, the interaction force generated between the sleeve 4 and the clamping assembly 3 is greater. In this way, the load-bearing capacity of the shelf is effectively improved. In this way, three frames are connected to the clamping assemblies on the pillars in turn, so that assembly of the shelve is completed.

The connection structures are detached during transportation of the shelf, so that the first tubes 1 are separated from the second tubes 2. Because the length of the pillar 6 is shortened, the first tubes 1 and the second tubes 2 can be accommodated on inner sides of the frames 5, so that the first tubes 1 and the second tubes 2 can be protected, and the first tubes 1 and the second tubes 2 are prevented from being damaged due to collision by an external force during transportation.

To sum up, the sleeve tube 11 of the first tube 1 is inserted at one end of the second tube 2, so that the first tube 1 is connected to the second tube 2. Clamping holes 10 are respectively provided in a wall of the sleeve tube 11 and a wall of the second tube 2, and the clamping hole 10 provided in the sleeve tube 11 is corresponding to the clamping hole 10 provided in the second tube 2 when the sleeve tube 11 is connected to the second tube 2. The clamping assembly 3 is clamped with the clamping hole 10 in the second tube 2 and the clamping hole 10 in the sleeve tube 11, to prevent separation of the first tube 1 and the second tube 2. In addition, the sleeve 4 is sleeved outside the clamping assembly 3, and the sleeve 4 and the clamping assembly 3 are clamped to each other, so that the sleeve 4 is relatively fastened relative to the first tube 1 and the second tube 2, and support for a connection between the first tube 1 and the second tube 2 is increased.

The foregoing descriptions are merely implementations of the present invention, but are not intended to limit the present invention. Various changes and modifications may be made to the present invention by those skilled in the art. Any modifications, equivalent substitutions, improvements, and the like made within the spirit and principle of the present invention should be included within the scope of the claims of the present invention.

What is claimed is:

1. A detachable shelf connection structure, comprising: a first tube, a second tube, a clamping assembly, and a sleeve, wherein the first tube comprises a sleeve tube and a connecting tube, and the sleeve tube is connected to one end of the connecting tube; both a wall of the sleeve tube and a wall of the second tube are provided with at least one clamping hole;

the sleeve tube is inserted into one end of the second tube, and when the sleeve tube is connected to the second tube, the clamping hole in the sleeve tube is corresponding to the clamping hole in the second tube respectively; the clamping assembly clamps the clamping hole in the sleeve tube and the clamping hole in the second tube; and the sleeve is sleeved outside the clamping assembly, and the sleeve and the clamping assembly are clamped to each other;

wherein the clamping assembly comprises a first clamping component and a second clamping component, the first clamping component comprises a first enclosure wall and a first clamping part, and the first clamping part is disposed on an inner side of the first enclosure wall; the second clamping component comprises a second enclosure wall and a second clamping part, and the second clamping part is disposed on an inner side of the second enclosure wall; and the first enclosure wall and the second enclosure wall are snap fitted, and the first clamping part and the second clamping part successively penetrate the clamping hole in the second tube and the clamping hole in the sleeve tube.

2. The detachable shelf connection structure according to claim 1, wherein the outer diameter of the sleeve tube is less than or equal to the inner diameter of the second tube.

3. The detachable shelf connection structure according to claim 1, wherein the outer diameter of the connecting tube is equal to the inner diameter of the second tube.

4. The detachable shelf connection structure according to claim 3, wherein the inner diameter of the clamping assembly is equal to the inner diameter of the second tube or the connecting tube.

5. The detachable shelf connection structure according to claim 1, wherein the clamping assembly has a first end and a second end, and the outer diameter of the clamping assembly gradually increases along a direction from the first end to the second end; the sleeve has a third end and a fourth end, and the inner diameter of the sleeve gradually increases along a direction from the third end to the fourth end; and a minimum inner diameter of the sleeve is less than or equal to a minimum outer diameter of the clamping assembly, and a maximum inner diameter of the sleeve is less than or equal to a maximum outer diameter of the clamping assembly.

6. The detachable shelf connection structure according to claim 1, wherein the at least one clamping hole is formed at one end of the connecting tube away from the sleeve tube.

7. The detachable shelf connection structure according to claim 1, wherein the at least one clamping hole is formed at one end of the second tube away from the first tube.

8. The detachable shelf connection structure according to claim 1, wherein an edge of the first enclosure wall is provided with a first snap-fit structure, an edge of the second enclosure wall is provided with a second snap-fit structure, and the first snap-fit structure and the second snap-fit structure are matched with each other.

9. A shelf, comprising the detachable shelf connection structure according to claim 1, and further comprising at least one frame, wherein the frame is configured to be connected to the sleeves.

* * * * *